US005575701A

United States Patent [19]

Hantman

[11] Patent Number: 5,575,701

[45] Date of Patent: Nov. 19, 1996

[54] CONSTRUCTION APPARATUS

[75] Inventor: Philip Hantman, Newcastle-upon-Tyne, England

[73] Assignee: Orda Industries (1969) Limited, Hagalil, Israel

[21] Appl. No.: 231,253

[22] Filed: Apr. 22, 1994

[51] Int. Cl.[6] ..... A63H 33/10

[52] U.S. Cl. ..... 446/104; 446/112; 446/120

[58] Field of Search ..... 446/111, 112, 446/108, 115, 116, 120, 121, 127, 102, 104

[56] References Cited

U.S. PATENT DOCUMENTS

| | | | |
|---|---|---|---|
| 2,057,942 | 10/1936 | Fay | 446/112 |
| 4,617,001 | 10/1986 | Parein | 446/104 X |
| 4,833,856 | 5/1989 | Zwagerman | 446/127 X |
| 5,046,982 | 9/1991 | Erickson | 446/112 |

FOREIGN PATENT DOCUMENTS

| | | | |
|---|---|---|---|
| 0058126 | 8/1982 | European Pat. Off. . | |
| 1015366 | 9/1957 | Germany | 446/111 |
| 713706 | 8/1954 | United Kingdom | 446/102 |
| 2077879 | 12/1981 | United Kingdom . | |

*Primary Examiner*—Mickey Yu
*Attorney, Agent, or Firm*—Rodman & Rodman

[57] ABSTRACT

Apparatus for constructing a variety of structures from a limited number of different components includes at least two generally planar members (10, 11, 12; 25), each having along at least one edge an elongate socket (13) formed from two aligned, spaced-apart sections ( 14, 15 ) , and at least one connector (18; 27) including a pair of cylindrical rods (19, 20; 29, 30 ) held in laterally-spaced relationship, the diameters of the rods being such as to provide a close fit within a socket (13).

4 Claims, 3 Drawing Sheets

CONSTRUCTION APPARATUS

The invention is concerned with apparatus by means of which a variety of structures may be constructed from a limited number of different components. The apparatus is of particular value as a toy in the form of a kit of such components, which may be purely for entertainment but may also have an educational benefit.

A number of prior apparatuses of the foregoing general type have been described. They are often quite complex and may be difficult to manipulate.

One form of prior construction apparatus has been described in European Patent Specification No. 0198652. That apparatus comprises a combination of elongate members, corner portions and connectors and the connectors each have a pair of elongate recesses into which pairs of the elongate members may be fitted in order to hold these members in fixed relative positions. In addition, by means of various protrusions, sockets and rods, various sub-assemblies of the foregoing components may in turn be connected together to create larger structures.

Against this background of assorted construction apparatuses of different degrees of complexity, the present invention has been devised to provide an alternative form of apparatus, which is relatively simple in form and easier to use than many prior such apparatuses and which in at least some of its forms affords advantages over those prior apparatuses.

The construction apparatus according to the present invention comprises at least two generally planar members, each said member having along at least one edge thereof an elongate socket comprising two mutually aligned, spaced-apart sections, and at least one connector comprising a pair of cylindrical rods held together in laterally-spaced relationship, the diameter of each said rod being such as to provide a close fit within a said elongate socket.

It will be understood that, by fitting the respective rods of a connector into the sockets of two of the planar members, the latter members may be linked together in a manner which allows their relative orientation to be varied by pivoting around the connector. By joining several planar members in chosen combinations by means of the appropriate number of connectors, structures of a wide variety of shapes may be constructed.

The generally planar members of the apparatus according to the invention may be of open, skeletal structure, for example simply flat shapes formed of straight edges, or may, preferably, be closed planar members. In plan view, they are preferably regular polygons, for example triangular, square, pentagonal or hexagonal members. In their closed form they may De regarded as generally flat, polygonal panels.

Along at least one side of each generally planar member an elongate socket is formed. Preferably a socket is provided along each edge of each member, for example four such sockets along the edges of a square planar member. Each socket comprises two sections, which are mutually aligned and spaced apart so as to form, in effect, a discontinuous socket which is open in the zone between the sections. Preferably the elongate socket comprises just two said sections but it may be formed in more than two sections if desired.

In order to receive and retain a rod of one of the connectors, each socket is preferably of generally circular cross-section, interrupted at one point around its circumference to permit insertion of a rod. Preferably the circumferential width of the gap is slightly less than the diameter of a rod, with the effect that the rod then may be a snap-fit within the socket.

The connectors each comprise a pair of laterally-spaced cylindrical rods. Each connector may comprise only two such rods but it is also possible to provide connectors having, say, three or four rods, either instead of connectors comprising only two rods or as additional components of a kit. Such connectors having more than two rods, it will be understood, allow three or more planar members to be interconnected to form a common linear joint. However, in general, connectors comprising only two spaced cylindrical rods suffice for most applications.

The cylindrical rods preferably lie parallel to each other but also may, if desired, be inclined to each other by an acute angle, preferably not exceeding ten degrees of arc. The rods are held in fixed laterally-spaced relationship, for example by a cross-piece which is located at a position between the ends of each rod (for example in the region of the middle of the length of the rod) corresponding to the position of the open zone between the sections forming the related socket. If the socket is formed in more than two sections, then the rods may be supported by two or more cross-pieces. In one particularly preferred form of the present invention, each cross-piece is of greater lateral width than the overall width of the spaced-apart rods in the same direction, so as effectively to fill the open space between aligned socket sections when the connector is in use.

While the primary function of the connectors in the construction apparatus according to the invention is to allow edge-to-edge interconnecting of pairs of the generally planar members, they may also be used to form other connections in various assembled structures. To this end, each planar member preferably has at least one pair of circular sockets in one or both of its planar faces, the sockets being spaced apart by an amount corresponding to the spacing apart of the rods of a connector. By inserting the rod ends of a connector into these circular sockets in two planar members, a user may connect the two planar members together in a parallel orientation. The connectors also may be provided with similar pairs of circular sockets, to allow direct connection between connectors and thereby afford a further constructional facility.

As a further optional feature of the construction apparatus according to the invention, one or more holes or circular sockets may be provided in the or each planar face of one or more of the generally planar members, for the purpose of mounting a wheel or a cog wheel thereon. In particular, cog wheels having projections to enable them to be mounted in this way may be of such radial dimensions as to allow cog wheels on adjacent planar members to intermesh. The same hole or circular socket may be designed to receive an axle upon which one or more wheels or cog wheels may be mounted, and/or to receive an on/off switch to enable a motorised structure to be readily switched on or off. The hole or holes may be located at the centre of the planar face or between the centre and the edge thereof.

Additional optional members of the apparatus may be provided as part of the basic apparatus or offered separately. These additional members may include said cog wheels, each of a suitable dimension relative to that of a planar member to be able to intermesh with a further cog wheel mounted upon an adjacent planar member. Each cog wheel may include a hole or socket in a planar surface thereof. A central hole or socket may be used for inserting a cog wheel connector by which the cog wheel may be connected to one or more planar members or other cog wheels. A further hole or socket located between the centre and the edge of the cog wheel may be especially suitable for inserting a handle connection, by which handle the cog wheel may be rotated.

A pair of circular sockets may also be provided in the planar surface of a cog wheel, which are of suitable dimensions and spacing to receive the rod ends of a connector. Thus an assembly of other members of the apparatus may be built and connected to the planar surface of a cog wheel by means of the connectors.

Cog connectors may be provided, which are adapted to connect a cog wheel to a planar member. A preferred form of cog connector comprises two oppositely directed pairs of generally parallel semi-circular projections, each projection preferably having a projecting rim. Each pair of projections is adapted to be a snap fit into a hole on either a planar member or a cog wheel and to be held in position by the rim. One form of preferred cog connector may be provided with a lug extending laterally from a semi-circular projection, which lug is adapted to engage in a slot provided on either a cog wheel or planar element into which the cog connector is located. A cog connector of this type may be used to transmit a driving force from a motor, for example, to a cog wheel or planar member.

The invention will now be further described with reference to the accompanying drawings, which illustrate, by way of example only, preferred forms of the construction apparatus according to the present invention and wherein.

Each of the illustrated planar members, 10, 11, 12 and 25 respectively, is formed as a one-piece moulding in coloured ABS plastic although other mouldable materials, for example PVC, nylon or polythene, could alternatively be used. Along each edge of each planar member an elongate socket 13 is formed of two aligned socket sections 14 and 15, separated by an open zone 16. Each socket section is generally circular in cross-section, the circumference of the socket being interrupted by a longitudinal slot 17 to allow a rod to be snap-fitted laterally into the slot as described below.

Figure 1:
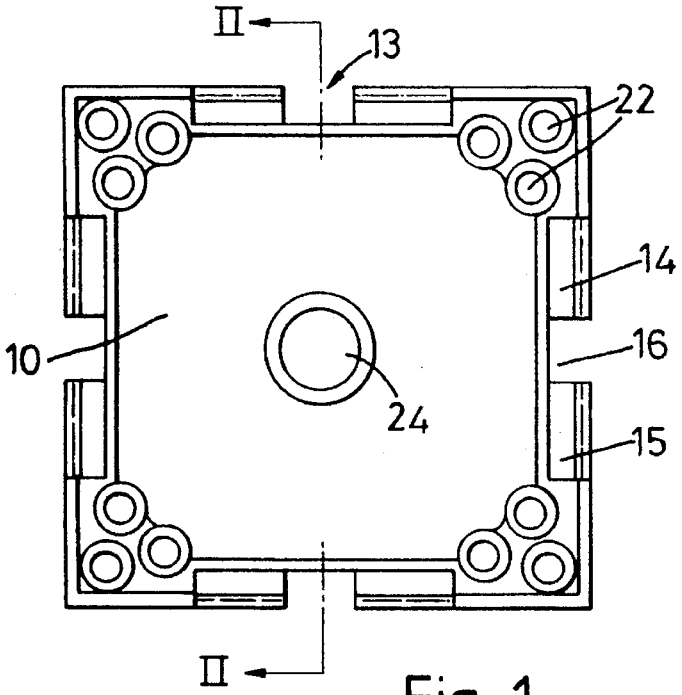
FIG. 1 is a plan view from the rear of a square planar member.
Figure 2:
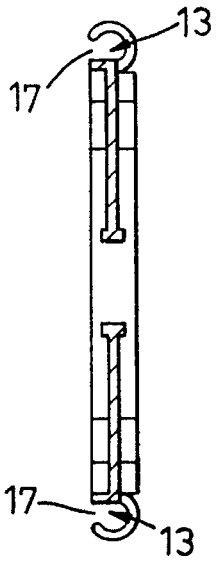
FIG. 2 is a sectional view along the line II—II of FIG. 1.
Figure 3:
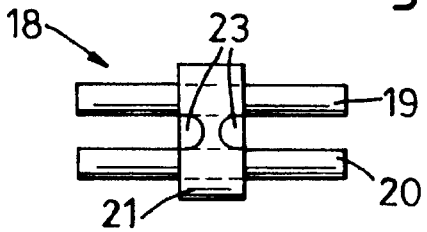
FIG. 3 is a plan view of a conntor.
Figure 4:
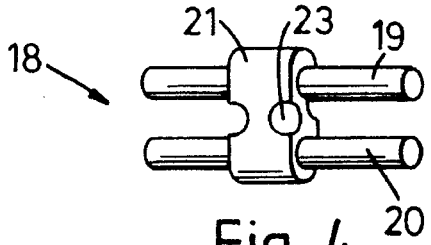
FIG. 4 is a perspective view of the connector of FIG. 3.
Figure 5:
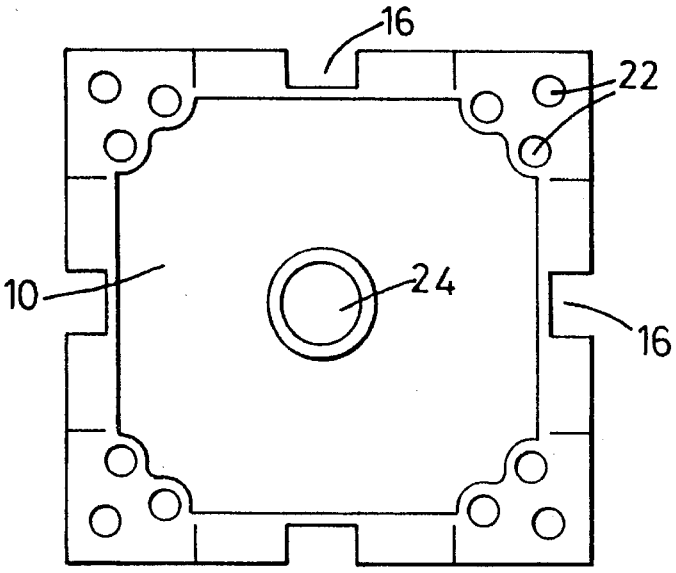
FIG. 5 is a plan view from the front of the square planar member of FIG. 1.
Figure 6:
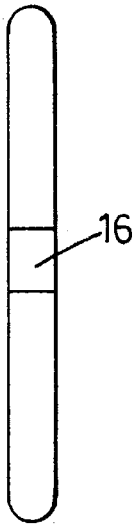
FIG. 6 is an end elevation of the square planar member.
Figure 7:
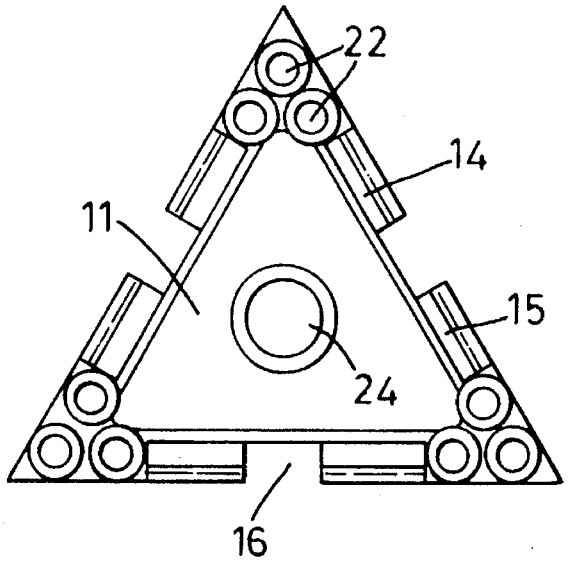
FIG. 7 is a plan view from the rear of a triangular planar member.
Figure 8:
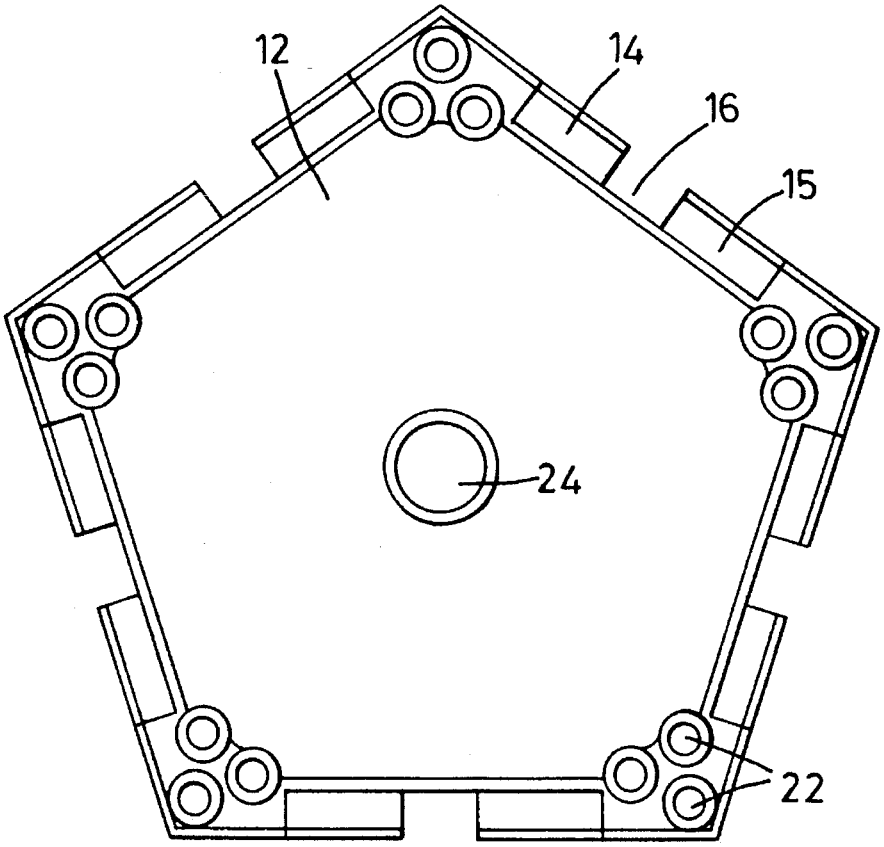
FIG. 8 is a plan view from the rear of a pentagonal planar member.

The connector 18 illustrated in FIGS. 3 and 4 is suitable for connecting together, edge to edge, any two planar members 10, 11, 12, 25, which may be the same as each other or different. The connector comprises two cylindrical rods, 19 and 20, held in spaced parallel positions by a cross-piece 21. The diameters of the rods and the lateral width of the cross-piece are such that the rods may be fitted closely into elongate sockets 13 and the cross-piece 21 will then fill the associated open zone 16. When two planar members are linked together by a connector 18 in this way, they may pivot freely relative to each other about the connector as pivot, to the extent that they may pivot from one limiting position in which they are back-to-back, to a second limiting position in which their front faces are in contact.

Planar members connected together in this way may readily be separated again by manual pressure upon the cross-piece 21.

Upon the planar faces of the members 10, 11, 12 and 25 are formed circular sockets 22, which are of similar diameter and relative spacing to the rods 19, 20. Pairs of similar sockets 23 are formed in the outer faces and ends of the cross-piece 21. By inserting the ends of rods 19, 20 into selected sockets 22 and/or 23, the connectors may be used to connect planar members in parallel arrangements and/or to join connectors to each other. These additional facilities of construction, employed as well as edge-to-edge connection of planar members as described above, enable a wide variety of simple and complex assemblies to be constructed, by means of a minimum number of different constructional pieces.

Holes 24 at the centres of the planar faces of the members 10, 11, 12 are provided to allow for mounting of wheels, cogs, axles and switches as discussed above.

Figure 9:
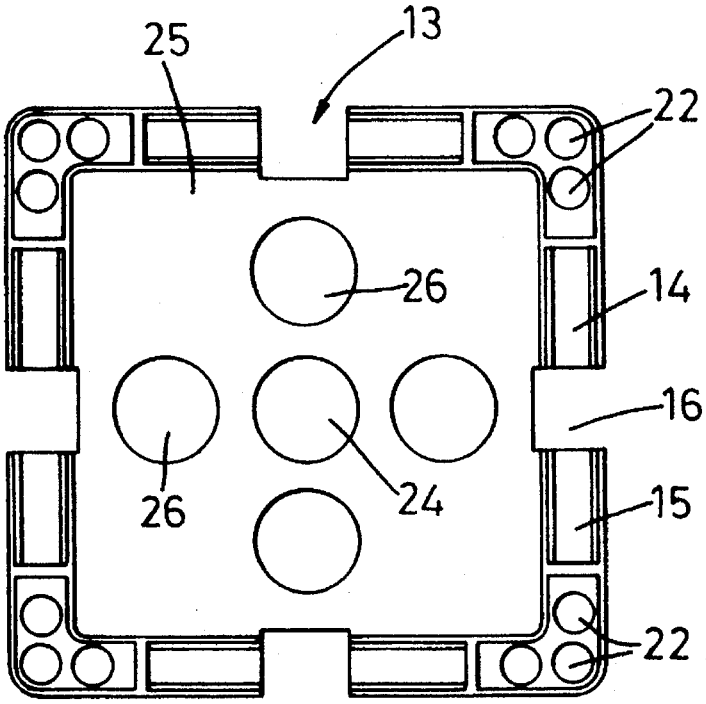
FIG. 9 is a plan view from the rear of an alternative form of square planar member.
Figure 10:
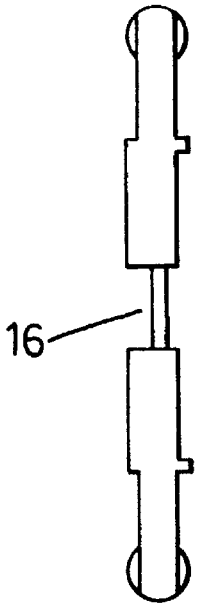
FIG. 10 is an end elevation of the square planar member of FIG. 9.

The form of square planar member 25 shown in FIGS. 9 and 10 is generally more rounded at its edges and corners and also has additional holes 26 in its planar face, to receive cog wheels, axles, switches and/or other optional components as discussed above.

Figure 11:
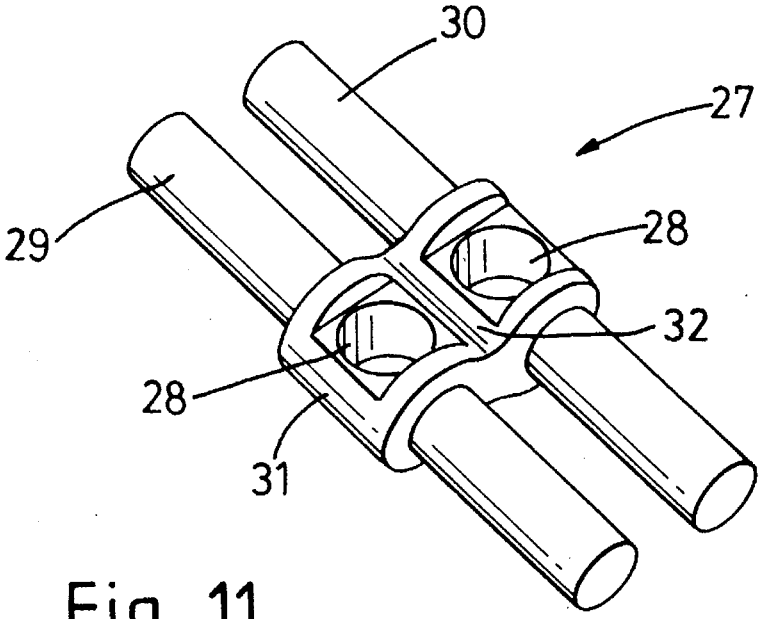
FIG. 11 is a perspective view, to a larger scale, of an alternative form of connector.

The alternative form of connector 27 illustrated in FIG. 11 may also be used to connect together any desired combination of the planar members 10, 11, 12 and 25. However it differs from the connector 21 shown in FIGS. 3 and 4 in two significant respects. Firstly, the sockets 28 are disposed transversely relative to the length of the rods 29, 30. Secondly the cross-piece 31 is of a cross-section resembling a figure eight; that is, a "waist" 32 is formed along its middle. The dimensions of the waisted cross-piece are such that, if two connectors 27 are presented to each other end-to-end, but displaced from each other by an angle of 90 degrees about their linear axes, then the rods 29, 30 of one connector can extend along opposite sides of the waist 32 of the other connector, to interlock the connectors to form an extended, generally linear construction, upon which other components may be mounted.

I claim:

1. Construction apparatus comprising at least two regular polygonal generally planar members, each of said members having along each edge thereof an elongate socket of generally circular cross-section and comprising two mutually aligned, spaced-apart sections, at least one connector comprising a pair of cylindrical rods held together in a mutually generally parallel, laterally spaced side by side relationship by a cross-piece located in the region of the middle of the length of said rods, the diameter of each of said rods being such as to be a close fit within a said elongate socket, each of said generally circular elongate sockets having a linear gap in its circumference, generally parallel to the length of the socket, to permit insertion of a said cylindrical rod, and each of said connectors having a pair of circular sockets adapted to receive the ends of the rods of another connector.

2. Construction apparatus comprising at least two regular polygonal generally planar members, each said member having along each edge thereof an elongate socket of generally circular cross-section and comprising two mutually aligned, spaced-apart sections, and at least one connector comprising a pair of cylindrical rods held together in a mutually generally parallel, laterally spaced side by side relationship by a cross-piece located in the region of the middle of the length of said rods, the diameter of each of said rods being such as to be a close fit within a said elongate socket, each of said generally circular elongate sockets having a linear gap in its circumference, generally parallel to the length of the socket, to permit insertion of a said cylindrical rod, each of said planar members having on a planar face thereof at least one pair of circular sockets, said sockets being adapted to receive the ends of the rods of a connector.

3. Construction apparatus according to claim 2 wherein the lateral width of said cross-piece is greater than the total width of said spaced-apart rods and of said space between them in the same direction.

4. Construction apparatus according to claim 2, wherein at least one hole or circular socket is provided in a planar face of a said planar member, whereby to enable the mounting of a wheel or cog wheel thereon.

* * * * *